US006295652B1

(12) United States Patent
Mazur

(10) Patent No.: US 6,295,652 B1
(45) Date of Patent: Oct. 2, 2001

(54) HELMET SOCK

(76) Inventor: Michael Mazur, 109 Chestnut Rd., Tyngsboro, MA (US) 01879

( * ) Notice: Subject to any disclaimer, the term of this patent is extended or adjusted under 35 U.S.C. 154(b) by 0 days.

(21) Appl. No.: 09/310,413

(22) Filed: May 12, 1999

(51) Int. Cl.[7] ..... A42B 3/04
(52) U.S. Cl. ..... 2/422; 2/468
(58) Field of Search ..... 2/410, 411, 422, 2/424, 205, 421, 425, 468

(56) References Cited

U.S. PATENT DOCUMENTS

| | | | | |
|---|---|---|---|---|
| 3,825,952 | | 7/1974 | Pershing et al. | 2/3 R |
| 4,017,906 | * | 4/1977 | Bochynsky et al. | 2/10 |
| 4,697,289 | | 10/1987 | Luigi | 2/422 |
| 4,887,319 | | 12/1989 | Daniels | 2/410 |
| 5,035,006 | * | 7/1991 | Hetz et al. | 2/209.1 |
| 5,062,163 | * | 11/1991 | Avey | 2/424 |
| 5,095,550 | | 3/1992 | Perlinger | 2/422 |
| 5,694,650 | * | 12/1997 | Hong | 2/424 |

FOREIGN PATENT DOCUMENTS

| | | | | |
|---|---|---|---|---|
| 2921353 | * | 12/1980 | (DE) | 2/424 |
| 1526574 | * | 9/1978 | (GB) | 2/424 |

* cited by examiner

*Primary Examiner*—Michael A. Neas
(74) *Attorney, Agent, or Firm*—Pearson & Pearson, LLP

(57) ABSTRACT

A helmet sock for protecting a helmet wearer from cold weather conditions while snowmobiling, motorcycling, skiing and other like activies. The helmet sock attaches to the outside lower perimeter of a helmet by a strip of hook and loop material such as Velcro-type material. A strip of Velcro-type material is secured to the outside lower perimeter of the helmet by pressure sensitive adhesive and a corresponding strip is attached to the upper inside circumference of the sock. The sock comprises an adjustable flap at the rear of the helmet for making a secure airtight fit on the helmet. The sock prevents outside air from penetrating and retains the body heat of the wearer in addition to stopping snow and wind from entering the bottom of the helmet. When the weather temperature rises, the sock may be rolled up and stretched around the bottom of the helmet or simply pulled off the perimeter of the helmet.

10 Claims, 5 Drawing Sheets

HELMET SOCK

BACKGROUND OF THE INVENTION

1. Field of the Invention

The present invention relates generally to a protective headgear, and more particularly to protecting a cold weather, helmet wearer while snowmobiling, motorcycling, skiing, etc. by closing the opening at the bottom of the helmet and around the wearer's neck without adversely affecting ventilation or visibility.

2. Description of Related Art

A helmet wearer while operating recreational vehicles or other equipment requires not only headgear for protection during an accident, but also headgear which provides weather protection usually in combination with another device. Helmet technology has improved over the years whereby today's helmets are provided with outside vents for breathing, fully padded inner shells, and fog free dual thermal face shields fully sealed at openings. Older headgear had a one layer face shield of clear plastic and any breath on the plastic visor would cause fog to occur on the visor. Also, air flow was required for the headgear wearer to breathe. Therefore, any device or skirt attached to the bottom of the helmet had to be made of course material in order to ventilate and to stop fogging, and such device or skirt required an opening in the back to allow expiration of breath.

In U.S. Pat. No. 3,825,952 issued Jul. 30, 1975 to Pershing et al., and assigned to Deere & Company, a helmet skirt is described. A helmet for covering the entire head of a wearer has a flexible skirt releasably secured to the periphery of the inside of the helmet adjacent the lower opening by a male strip of material having the trademark name Velcro®. The inside of the helmet is provided with a female strip of the Velcro-type material. The skirt comprises a substantially rectangular piece of course knit material having a width sufficient for the skirt to extend between the helmet and the upper back and the shoulders of a wearer of the helmet. However, the course knit material provides for air flow and no heat retention.

In U.S. Pat. No. 4,697,289 issued Oct. 6, 1987 to Nava P. Luigi, a weather protection device is described suitable for attachment to sports helmets to provide protection against weather conditions. The protective screen is removed through an aperture by opening a zipper and the edge of the screen is secured to the lower part of the helmet by suitable movable anchorages. The protective screen comprises a flexible element made of textile material which covers the bottom front of the helmet. However, this protective device is only partly flexible and comprises an envelope provided with an annular element adapted to forcibly engage the lower edge of the helmet.

In U.S. Pat. No. 5,095,550 issued Mar. 17, 1992 to Jon A. Perlinger, a closure of wind resistant material for motorcycle helmets is described. A front flap opens to allow the head of the helmet wearer to pass through the closure into the helmet. The front flap closes with hook and loop or other fastener. The rear of the closure has an elastic panel to allow stretching as the helmet passes over the head. However, this helmet closure does not provide protection for the neck of a helmet wearer against cold weather conditions although it prevents noise, sand, dust, bugs, etc., from entering the helmet.

SUMMARY OF THE INVENTION

Accordingly, it is therefore an object of this invention to provide a helmet sock for easy attachment to the lower periphery of a helmet, particularly a snowmobile helmet.

It is another object of this invention to provide a helmet sock that protects the helmet wearer during cold weather conditions by not only preventing snow from entering the helmet but also preventing air or wind from entering.

It is a further object of this invention to provide a weather protective sock that easily attaches and detaches from the helmet.

It is another object of this invention to enable the sock to fit airtight on a plurality of various size helmets having a bottom circumference within a predetermined range.

It is yet another object of this invention to provide a quick way to install a helmet sock on a helmet not previously adapted for securing a helmet sock on the outside of the helmet.

These and other objects are further accomplished by a headgear for cold weather protection comprising a helmet, the helmet comprises means for keeping a face shield of the helmet clear and means for a wearer of the helmet to breathe outside air, means for adhering a strip of fastening material to the perimeter of a lower portion of the helmet, and means for releasably attaching to the fastening strip a sock of a predetermined length between the fastening strip and shoulders of a wearer, the sock comprises material means for heat retention and outside air exclusion. The sock comprises means for tightly securing the upper portion of the sock around the perimeter of the helmet. The sock comprises a strip of releasably attaching means secured to an inside upper perimeter of the sock. The releasably attaching means comprises a hook and loop material. The adhering means comprises a pressure to sensitive adhesive for adhering the fastening material to the lower portion of the helmet.

The objects are further accomplished by a sock for attaching to a helmet to provide weather protection comprising material means for implementing the sock providing heat retention and preventing outside air from passing therethrough, the material means being formed in a hollow cylindrical shape, means attached to an inside upper perimeter of the sock for releasably attaching the sock to the helmet, and means disposed at an upper opened portion of the sock for tightly securing the sock to a lower portion of the helmet. The material means comprises a fleece-type material. The helmet comprises a strip of hook and loop fastening material attached to a lower outside perimeter thereof by pressure sensitive adhesive.

The objects are further accomplished by a method of providing headgear with cold weather protection comprising the steps of providing a helmet with means for keeping a face shield of the helmet clear, providing means in the helmet for a wearer to breathe outside air, adhering a strip of fastening material to a perimeter of a lower portion of the helmet, attaching to the fastening strip a sock of predetermined length between the fastening strip and shoulders of a wearer, the sock being easily releasable from the fastening strip, and providing material for the sock capable of heat retention and outside air exclusion. The step of attaching the sock to the fastening strip comprises the step of tightly securing the upper portion of the sock to the helmet. The step of adhering a strip of fastening material to the lower perimeter portion of the helmet comprises the step of providing pressure sensitive adhesive on the opposite side of the fastening material side. The step of attaching a sock to the fastening strip comprises the step of providing a fleece material for the sock.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
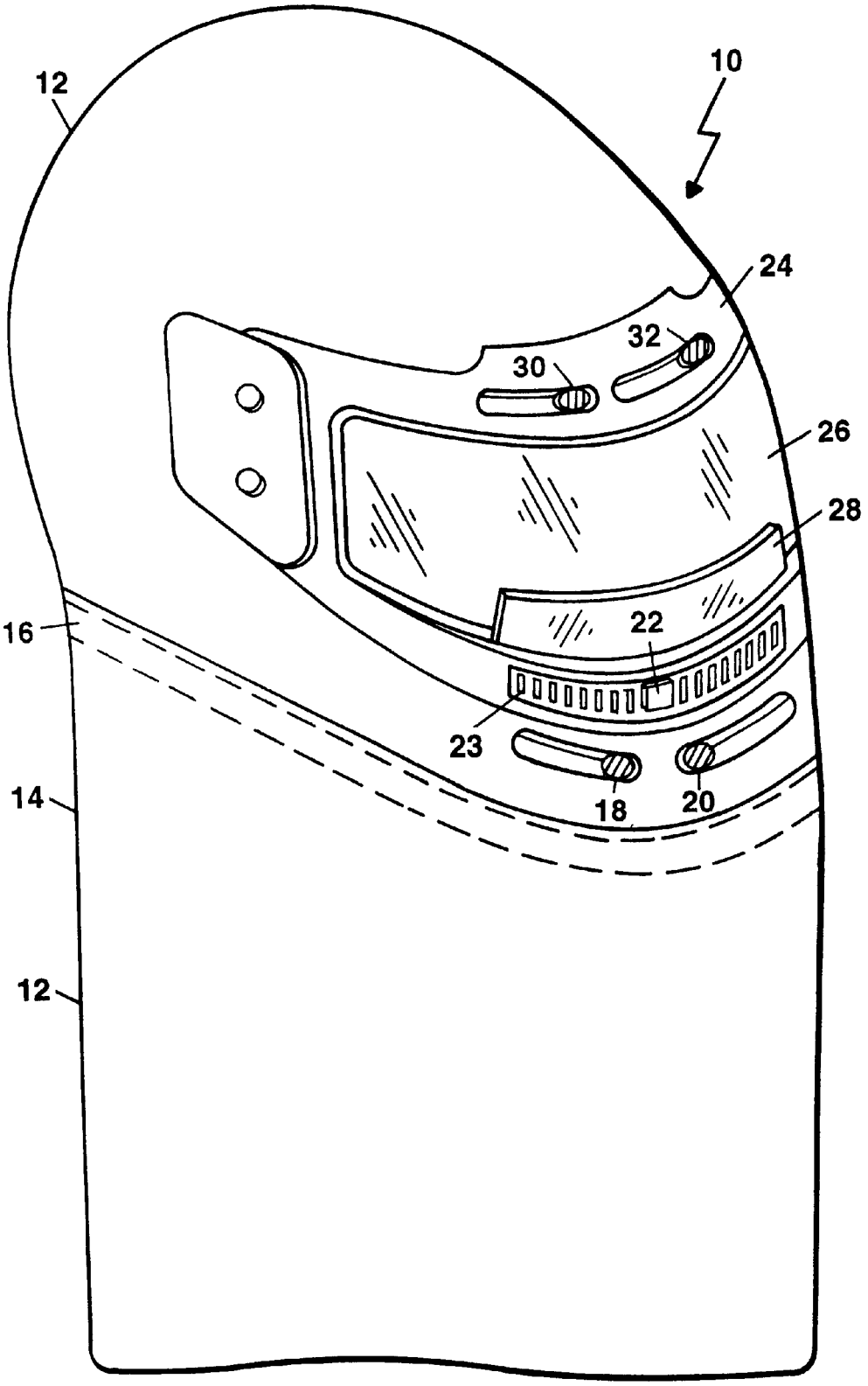
FIG. 1 is a perspective view of headgear showing a helmet having a helmet sock attached to the lower outside perimeter by means of strip of Velcro-type material.

Referring to FIG. 1, a perspective view of headgear 10 comprising a helmet 12 and a protective sock 14 attached to the outside lower perimeter of the helmet 12. The helmet 12 comprises a fog free dual thermal face shield 26 fully sealed at openings. Vents 23 are provided for air flow through the clear face shield 26, and the air flow is adjustable via a control button 22. Air for breathing is provided by vent adjustors 18, 20. The inner shell (not shown) of the helmet 12 is fully padded providing safety protection, and proper fit.

Figure 2:
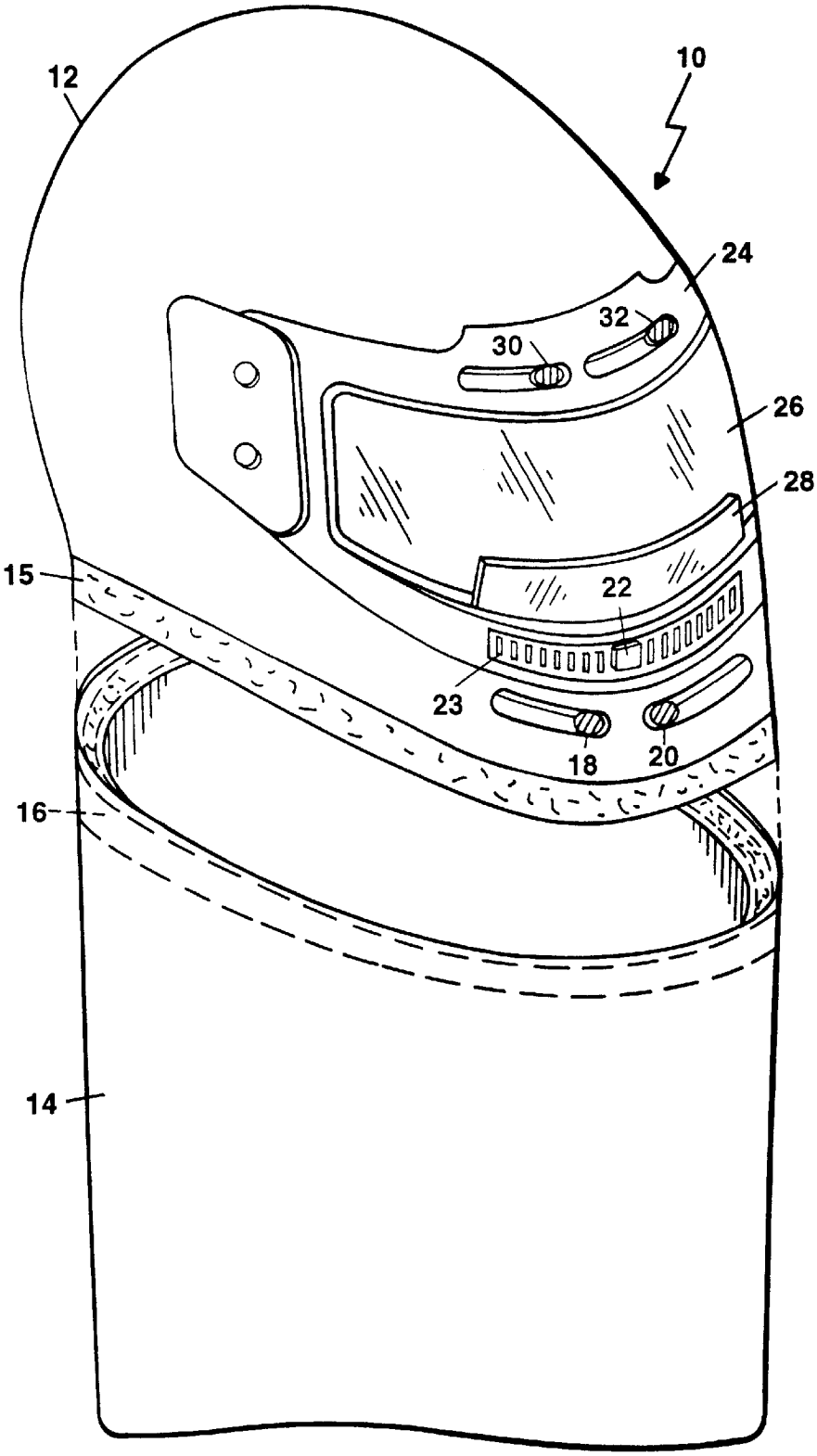
FIG. 2 is an exploded perspective view of the headgear of FIG. 1 showing the combination of the helmet and the helmet sock which is attached to the lower perimeter of the helmet.

Referring to FIG. 1 and FIG. 2, FIG. 2 is an exploded perspective view of the headgear 10 showing the combination of the helmet 12 and the protective sock 14 having a male strip 16 of self engaging elements such as hook and loop material, which is embodied by the registered trademark Velcro, attached to the inside upper circumference of the sock 14. A female strip 15 of similar Velcro-type material is attached to the outside lower perimeter of the helmet 12 by pressure sensitive adhesive commonly known in the art, on the opposite side of the strip 15. The helmet sock 14 hangs down to the shoulders and upper back of the wearer, and it is generally tucked within the collar of an outer garment.

Figure 3:
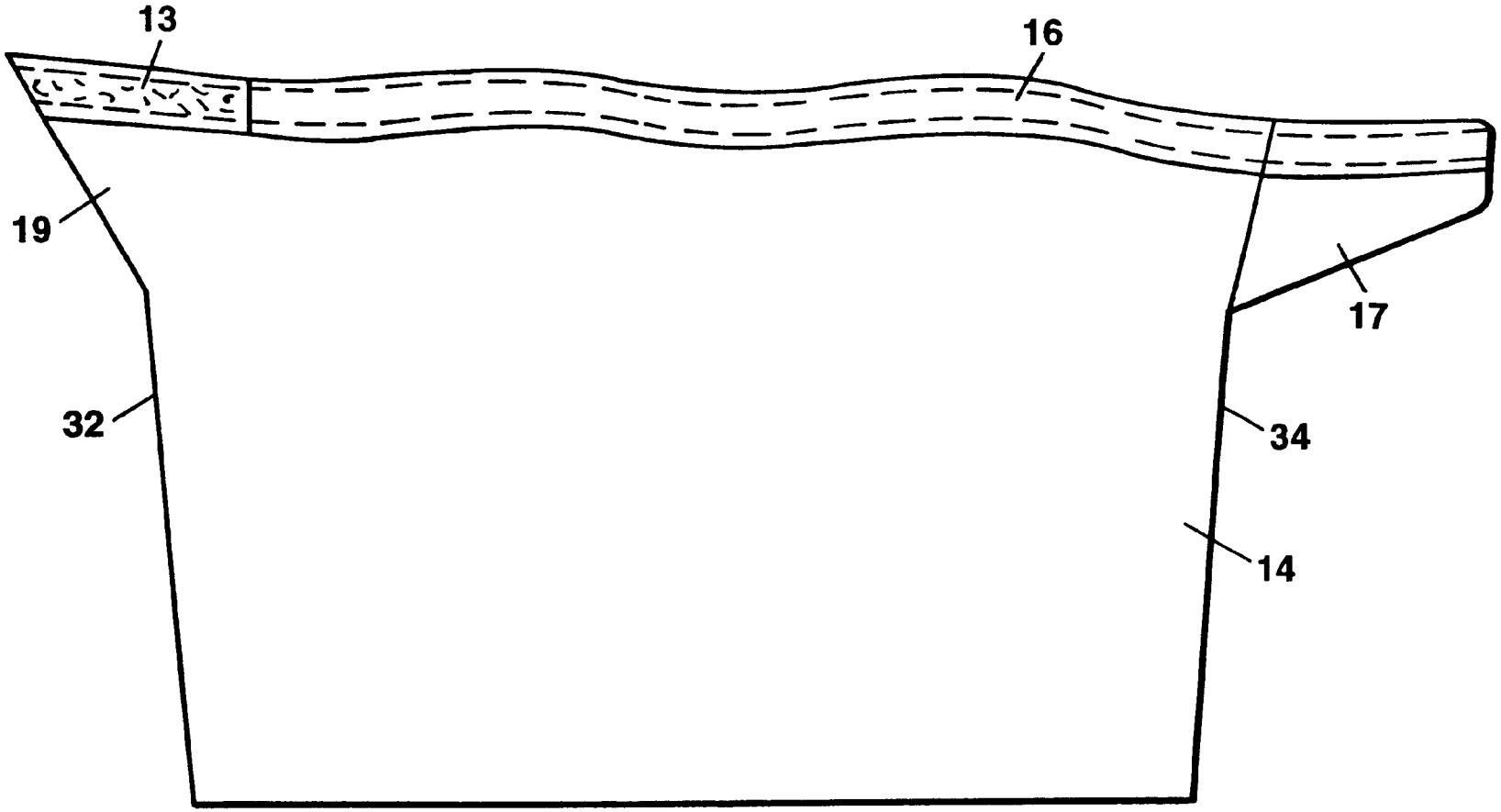
FIG. 3 is a front elevational view of the helmet sock opened in a horizontal plane, prior to being sewn into a cylindrical shape, showing the Velcro-type area that receives and secures the flap when the helmet sock is attached to the helmet.

Referring now to FIG. 3, a front elevational view of the helmet sock 14 is shown in a partially constructed, opened position prior to the edges 32, 34 being sewn together. The sock generally has an upper width of thirty-eight (38) inches including a (3) three inch flap 17 and a length of fourteen (14) inches. The width at the bottom of the sock is approximately 24 inches. Design choice permits some variance in all the dimensions. The sock 14 is embodied with a fleece-type material, although other materials may be used having the qualities of flexibility to raise the sock 14 over the helmet 12, heat retention, and preventing outside air from penetrating the material.

The upper edge of the sock 14 attaches to the Velcro-type strip 15 on the outside lower perimeter of the helmet 12. The flap 17 attaches to a short strip of Velcro material 13 attached to the outside of the sock 14 in order to provide an air tight fit around various sizes of the helmet 12. The sides 32, 34 are attached together below the flap 17.

Figure 4:
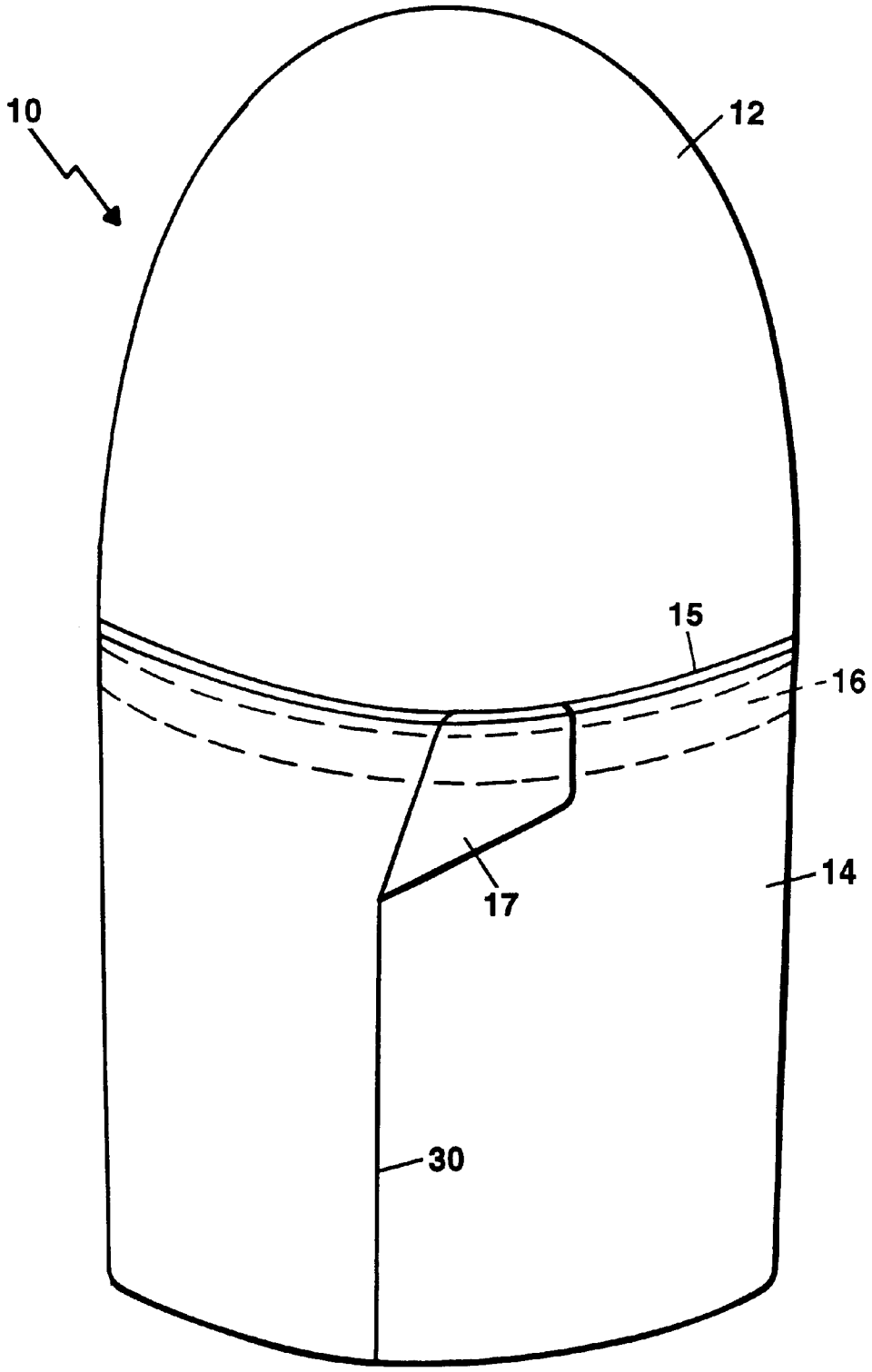
FIG. 4 is a rear elevational view of the combination of helmet and sock showing a fold over tab for proper fit of the sock on various size helmets.

Referring to FIG. 4, a rear elevational view of the headgear 10 combination of the helmet 12 and the helmet sock 14 is shown with the flap 17 attached to the short strip. Velcro-type material 13 on the outside of the sock 14. Often when the helmet sock 14 is in use the weather may warm-up and continued wearing of the helmet sock 14 is no longer desired. The wearer can simply roll the sock 14 up around the lower edge of the helmet 12. Also, the helmet sock 14 may be pulled away from the lower edge of the helmet 12 and stored in the wearer's pocket.

Figure 5:
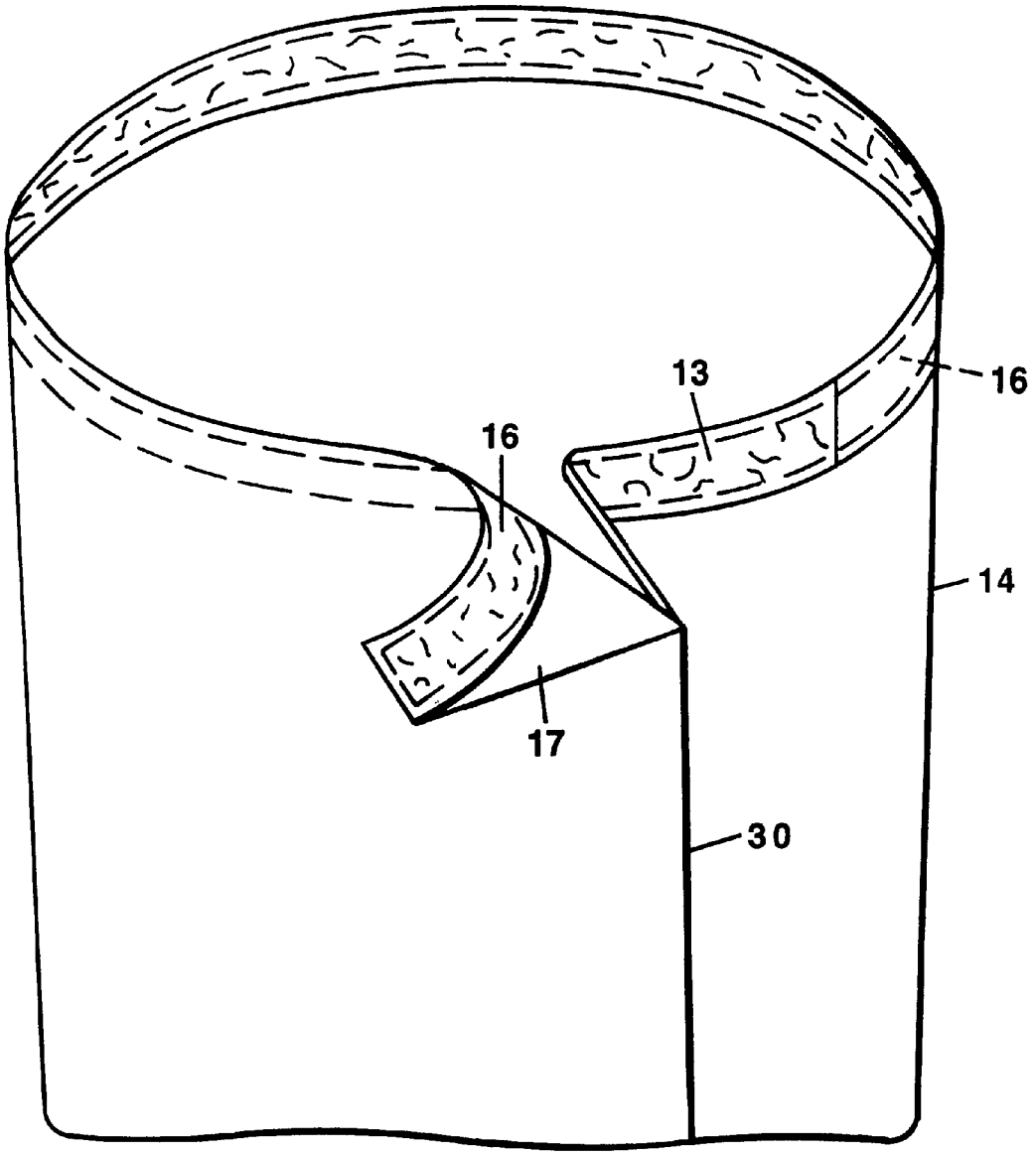
FIG. 5 is a perspective view of the helmet sock having a Velcro-type strip attached to the upper inside circumference and showing the closure tab folded back exposing the Velcro-type strip for making an air-tight closure around the helmet.

Referring now to FIG. 3 and FIG. 5, FIG. 5, shows a perspective view of the helmet sock 14 with the flap 17 folded back exposing the male Velcro-type strip 16. The two edges 32, 34 of sock 14 in FIG. 3 are attached together at seam 30 from the lower portion of flap 17 to the bottom of the sock 14. The flap 17 attaches to the short female Velcro material 13 secured to the outside of the sock 14.

This invention has been disclosed in terms of a preferred embodiment. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. Headgear for cold weather protection comprising:

a helmet;

said helmet comprises means for keeping a face shield of said helmet clear and means for a wearer of said helmet to breathe outside air;

means for adhering a strip of fastening material to the outside perimeter of a lower portion of said helmet;

a hollow cylindrically shaped sock of a predetermined length extending between said fastening strip and shoulders of a wearer, said sock comprises flexible material means for heat retention and outside air exclusion;

means for releasably attaching said sock to said fastening material strip; and said sock further comprises a flap disposed on an upper portion of said sock to provide a tight closure of said sock on various sizes of said helmet.

2. The headgear as recited in claim 1 wherein said means for releasably attaching said sock comprises a strip of releasably attaching material secured to an inside upper perimeter of said sock.

3. The headgear as recited in claim 2 wherein said releasably attaching material comprises a hook and loop material.

4. The headgear as recited in claim 1 wherein said adhering means comprises a pressure sensitive adhesive for adhering said fastening material to said lower portion of said helmet.

5. A sock for attaching to a helmet to provide weather protection comprising:

flexible material means for implementing said sock to provide heat retention and to prevent outside air from passing therethrough;

said flexible material means being formed in a hollow cylindrical shape;

means attached to an inside upper perimeter of said sock for releasably attaching said sock to said helmet; and a flap disposed at an upper opened portion of said sock for tightly securing said sock to a lower portion of various sizes of said helmet.

6. The sock as recited in claim 5 wherein said flexible material means comprises a fleece-type material.

7. The sock as recited in claim 5 wherein said helmet comprises a strip of hook and loop fastening material attached to a lower outside perimeter thereof by pressure sensitive adhesive.

8. A method of providing headgear with cold weather protection comprising the steps of:

providing a helmet with means for keeping a face shield of said helmet clear;

providing means in said helmet for a wearer to breathe outside air;

adhering a strip of fastening material to an outside perimeter of a lower portion of said helmet;

attaching to said fastening strip a hollow cylindrically shaped sock of predetermined length extending between said fastening strip and shoulders of a wearer, said sock being easily releasable from said fastening strip;

providing flexible material for said sock capable of heat retention and outside air exclusion; and disposing a flap at an upper portion of said sock to tightly secure said sock to a lower portion of various sizes of said helmet.

9. The method as recited in claim 8 wherein said step of adhering a strip of fastening material to the lower perimeter portion of said helmet comprises the step of providing pressure sensitive adhesive on the opposite side of said fastening material side.

10. The method as recited in claim 8 wherein said steps of attaching a hollow cylindrically shaped sock to said fastening strip and providing flexible material for said sock comprises the step of providing a fleece material for said sock.

* * * * *